US010480727B1

(12) United States Patent
Hagopian

(10) Patent No.: US 10,480,727 B1
(45) Date of Patent: Nov. 19, 2019

(54) TREE ILLUMINATING DEVICE

(71) Applicant: Brian J. Hagopian, Mountain House, CA (US)

(72) Inventor: Brian J. Hagopian, Mountain House, CA (US)

( * ) Notice: Subject to any disclaimer, the term of this patent is extended or adjusted under 35 U.S.C. 154(b) by 0 days.

(21) Appl. No.: 16/257,733

(22) Filed: Jan. 25, 2019

Related U.S. Application Data

(60) Provisional application No. 62/621,909, filed on Jan. 25, 2018.

(51) Int. Cl.

| | |
|---|---|
| ***F21S 6/00*** | (2006.01) |
| ***F21S 4/10*** | (2016.01) |
| ***F21V 23/06*** | (2006.01) |
| ***F21V 31/00*** | (2006.01) |
| ***H05B 37/02*** | (2006.01) |
| ***F21V 7/00*** | (2006.01) |
| *F21W 121/04* | (2006.01) |

(52) U.S. Cl.
CPC ..... *F21S 4/10* (2016.01); *F21V 7/0075* (2013.01); *F21V 23/06* (2013.01); *F21V 31/005* (2013.01); *H05B 37/029* (2013.01); *F21W 2121/04* (2013.01)

(58) Field of Classification Search
CPC ..... F21S 4/10; H05B 37/029; F21V 7/0075; F21V 23/06; F21V 21/005; F21W 2121/04
See application file for complete search history.

(56) References Cited

U.S. PATENT DOCUMENTS

| | | | | |
|---|---|---|---|---|
| 2,857,506 | A | 10/1958 | Minteer | |
| 3,019,357 | A | 1/1962 | Zaffina | |
| 3,321,730 | A | 5/1967 | Schlangen | |
| 4,462,065 | A | 7/1984 | Rhodes | |
| 5,746,504 | A | 5/1998 | Dodson | |
| 9,364,113 | B2 * | 6/2016 | Gary | G09F 19/02 |
| 2015/0164164 | A1 * | 6/2015 | Trotter | A41G 1/007 362/123 |
| 2019/0110625 | A1 * | 4/2019 | Hale | A47G 33/08 |

* cited by examiner

*Primary Examiner* — Ali Alavi
(74) *Attorney, Agent, or Firm* — Cramer Patent & Design, PLLC; Aaron R. Cramer

(57) ABSTRACT

A tree illumination device includes at least one (1) illumination source secured beneath a hemispherical dome on a platform. The dome further has a reflective portion disposed capable of reflecting incident illumination generated from the illumination source towards the tree. The device is capable of being secured about the trunk of a tree.

20 Claims, 6 Drawing Sheets

TREE ILLUMINATING DEVICE

RELATED APPLICATIONS

The present invention is a continuation of and claims the benefit of U.S. Provisional Application No. 62/621,909, filed Jan. 25, 2018, the entire disclosures of which are incorporated herein by reference.

FIELD OF THE INVENTION

The presently disclosed subject matter is directed to a tree illuminating device.

BACKGROUND OF THE INVENTION

During the winter season, or almost at any time, there is a desire to provide decorative effects to one-s property. String lights, lawn decorations, and other such decorative effects are usually seen in neighborhoods. Trees that are on the property also get the treatment, whether string lights, garland, or other decorative effects are attached to or surround the tree.

However, these typical decorative effects are not as flashy or awe-inspiring as they could be. Great leaps in technology enables more and more different and state-of-the-art decorative effects to be used, and trees that are prominent on properties are usually the first to be viewed. Thus, the present invention fulfills the need for a specific decorative effect to be easily attached to a tree.

SUMMARY OF THE INVENTION

The principles of the present invention provide for a tree illumination device, comprising a plurality of platforms which have a first side and a second side which are opposite the first side. The first side having a width and the second side having a width. A dome is also provided which is supported on each the platform. The dome has at least one illuminating device attached to it. The dome includes a first transparent portion and a second portion which has a reflector which covers a rear portion thereof and extends inwards within the dome and terminates prior to the at least one illuminating device. A control means is also provided which is mounted within the platform and is in electrical communication with the at least one illuminating device. A mount is also provided which extends downward the second side. The mount has a front wall abutting a tree and a pair of sidewalls each having a coaligned strap aperture.

There are one or more straps with each having a pair of distal ends that mate with each other. The one or more straps extend through the coaligned strap aperture and secure the tree illumination device to the tree. There is also a first cord extending away from each the platform. The first cord terminates in a first electrical connector. A second cord is also provided and extends away from each platform. The second cord terminates in a second electrical connector. The first electrical connector and the second electrical connector are capable of being in electrical communication with a power source and capable of being in electrical communication with each other.

The platforms may be a planar wedged shaped surface of which the first side may be linear. The first side may also be curvilinear to enable greater contact with the tree while the second side is curvilinear to enable greater contact with the tree. The second side width is smaller than the first side width. The dome is centered on each the platform. The dome is removably attached to each the platform. The dome may have a hemispherical body. Each one illuminating device may be in electrical communication with a power source and may be selected from the group consisting of at least one light-emitting diode, at least one laser, at least one incandescent bulb, or at least one fluorescent bulb.

At least one illumination device may be programmed to provide a pattern effect and may be programmed to provide a random pattern effect. A waterproof seal between the dome and the platforms for sealing out moisture and debris may also be provided. The control means may be in electrical communication with the power source. The first cord may be opposite the second cord. The first cord and the second cord may be in electrical communication with an over-current protection device, a power supply, and a driver circuit. A switch located on an external surface of the platform to provide electrical power to the tree illumination device may also be provided. The tree illumination device may be made of plastic and/or weatherproof material.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
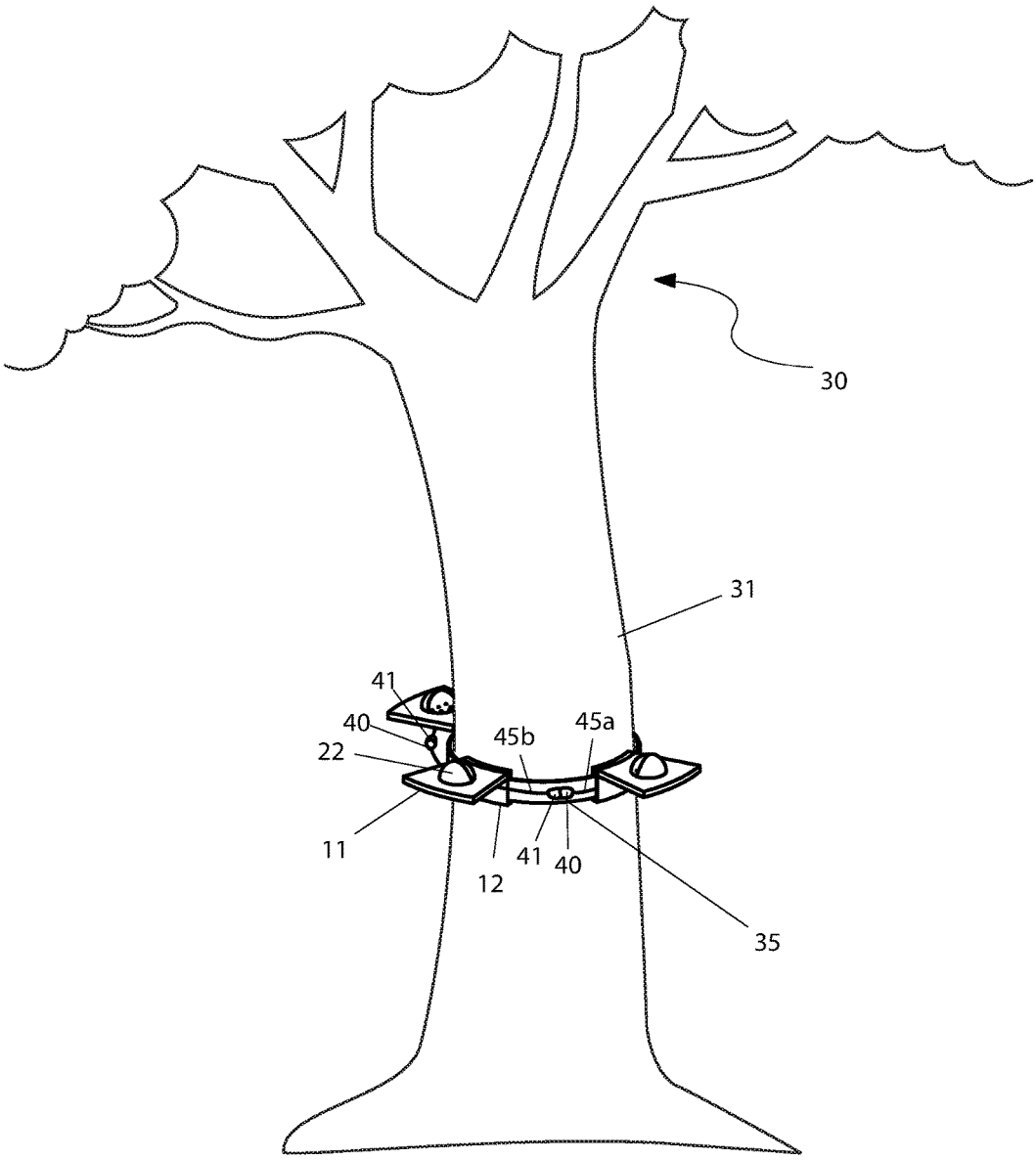
FIG. 1 is an environmental view of a plurality of tree illumination device 10 installed about a trunk 31 of a tree 30, according to the preferred embodiment of the present invention.

10 tree illumination device
11 platform
12 mount
13 strap aperture
14 first side
15 second side
20 dome
21 illuminating device
22 reflector
23*a* illumination
23*b* reflected illumination
30 tree
31 trunk
35 strap
40 male plug
41 female plug
45*a* first cord
45*b* second cord

47 switch
50 over-current protective device
51 power supply
52 driver circuit

1. DESCRIPTION OF THE INVENTION

Figure 2:
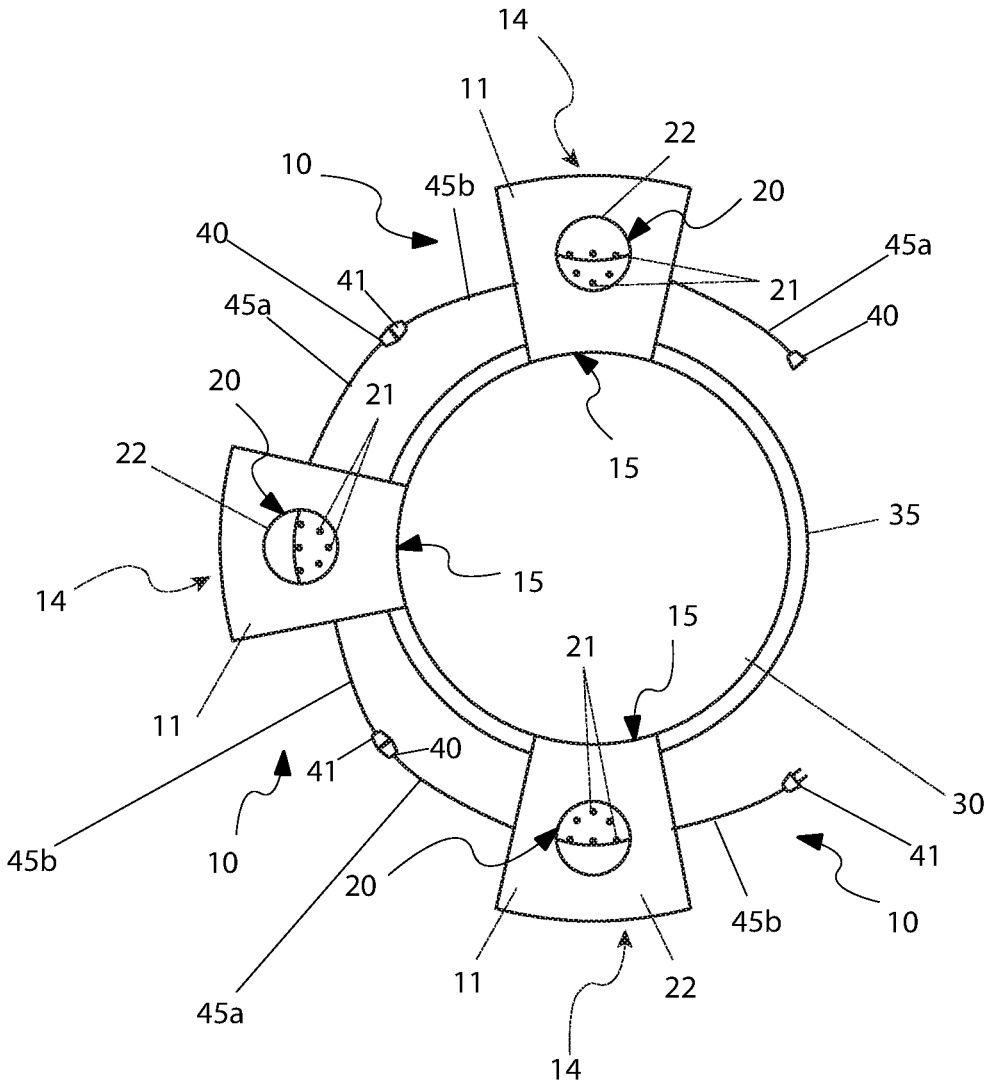
FIG. 2 is a top plan view of a plurality of tree illumination devices 10 mounted to a tree 30, according to a method of use of the present invention.
Figure 3:
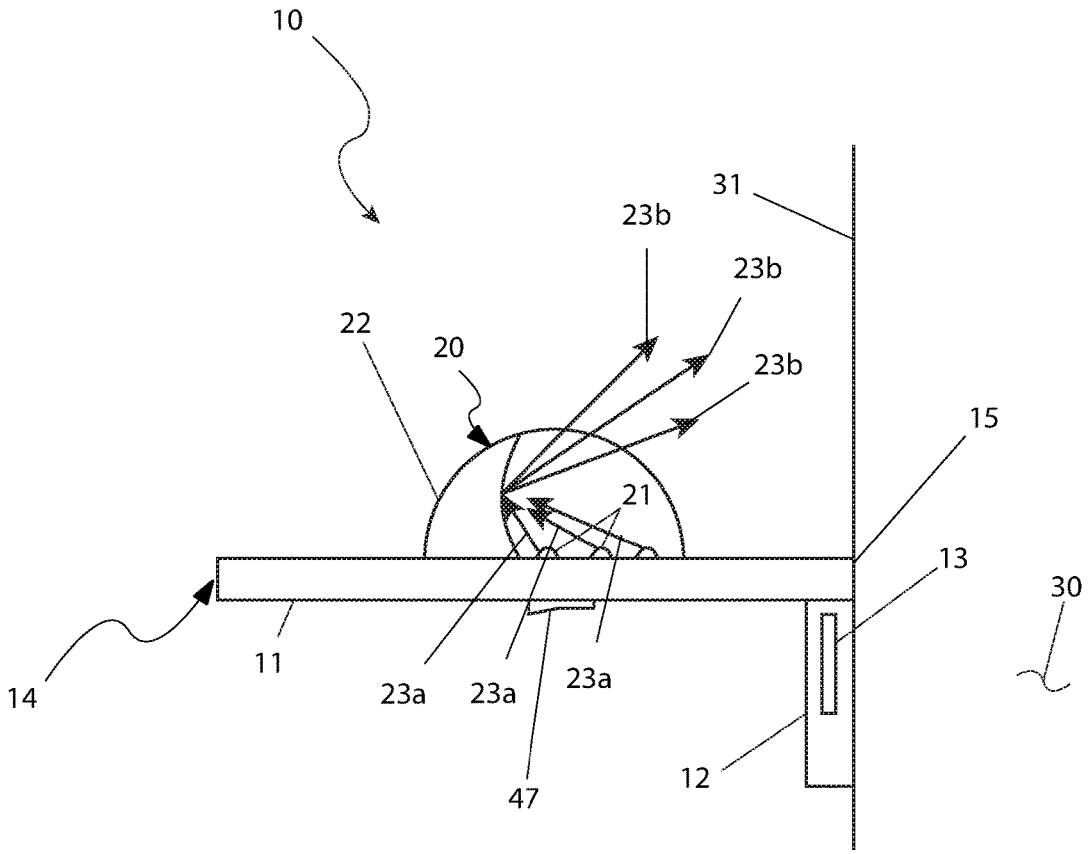
FIG. 3 is a side elevation view of an individual tree illumination device 10, according to the preferred embodiment of the present invention.
Figure 4:
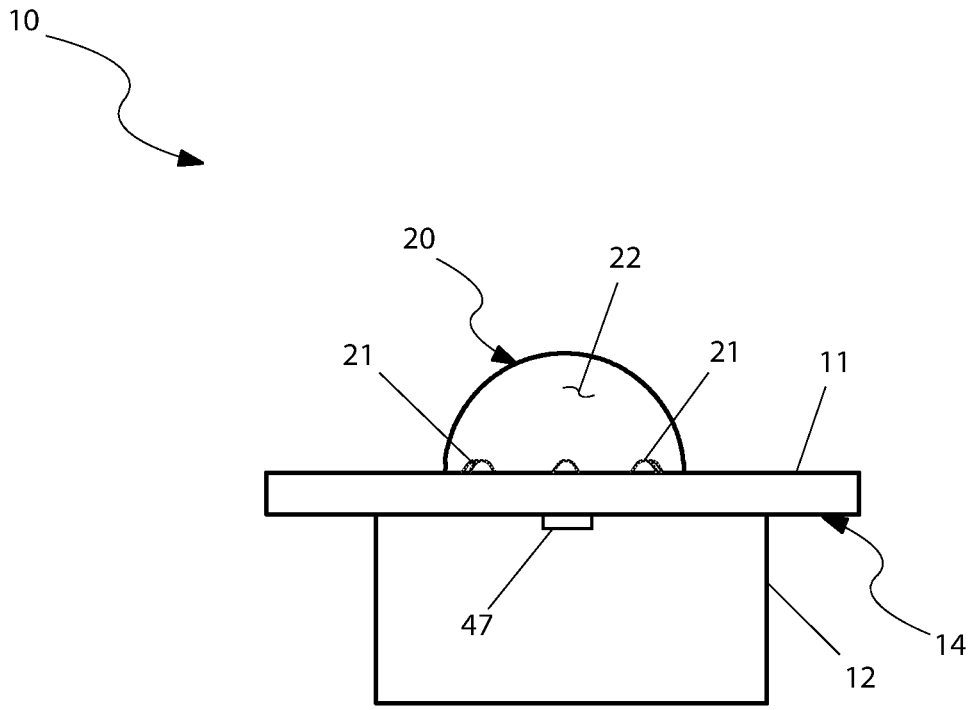
FIG. 4 is an elevation view of a first side 14 of an individual tree illumination device 10, according to the preferred embodiment of the present invention.
Figure 5:
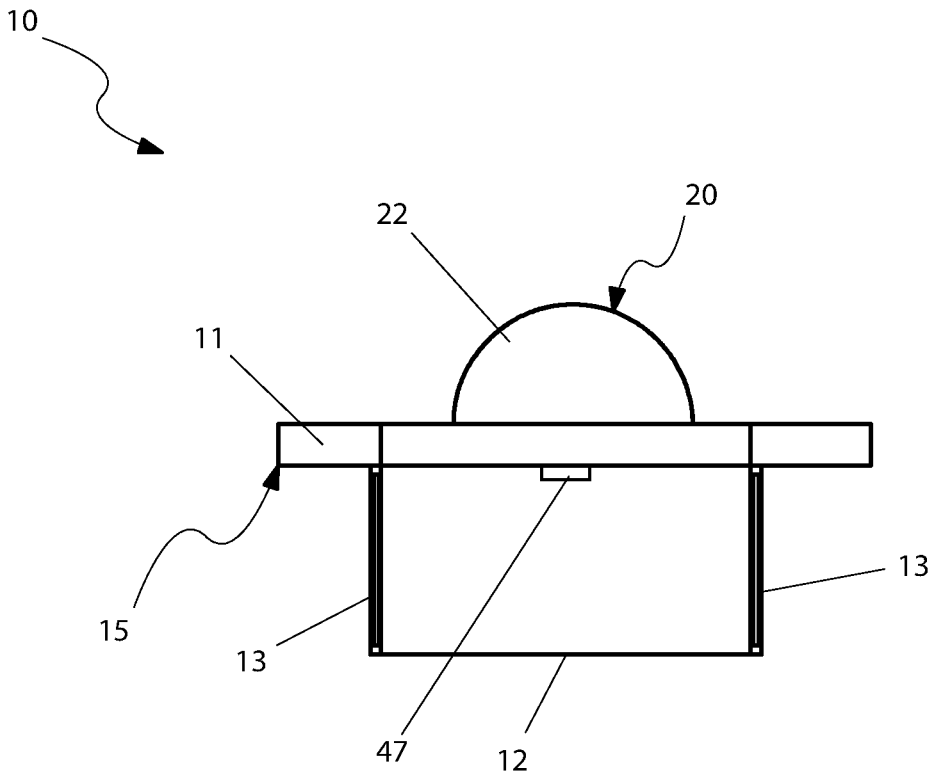
FIG. 5 is an elevation view of a second side 15 of an individual tree illumination device 10, according to the preferred embodiment of the present invention; and, FIG. 6 is an electrical schematic of the tree illumination device 10, according to the preferred embodiment of the present invention.
Figure 6:
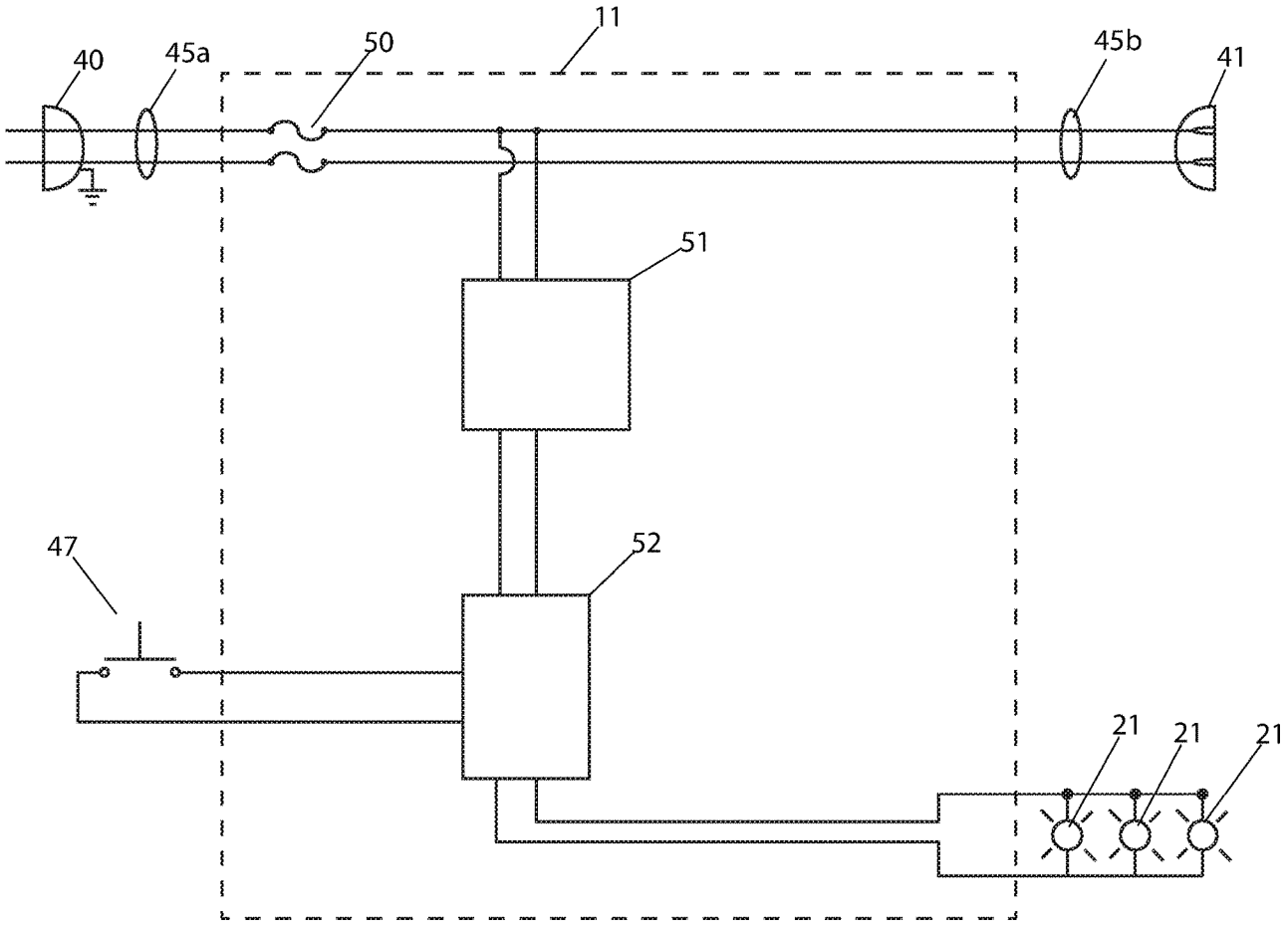

The best mode for carrying out the invention is presented in terms of its preferred embodiment, herein depicted within FIGS. 1 and 2. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope. All the implementations described below are exemplary implementations provided to enable persons skilled in the art to make or use the embodiments of the disclosure and are not intended to limit the scope of the disclosure, which is defined by the claims.

The terms "a" and "an" herein do not denote a limitation of quantity, but rather denote the presence of at least one (1) of the referenced items.

2. DETAILED DESCRIPTION OF THE FIGURES

The present invention is a tree illumination device 10 that includes a platform 11 capable of being mounted to a tree 30, and dome 20 having at least one (1) illuminating device 21 attached therein, each in electrical communication with a power source. The device 10 is intended to be mounted to a tree 30 such that illumination 23*a* and reflected illumination 23*b* is directed towards the tree 30 to provide a pleasing and aesthetic decorative effect. This is best illustrated in FIG. 1, where in an exemplary embodiment, three (3) devices 10 are mounted to a trunk 31 of a tree 30 with a strap 35. The strap 35 can have distal ends that are capable of mating with each other to secure however many devices 10 are desired. The devices 10 can be positioned along any part of the trunk 31 of the tree 30 in order to provide direction of illumination 23*a* and reflected illumination 23*b* thereon. The devices 10 can be in electrical communication with a power source and with each other in a "daisy chain" connection. Such a power source can be a residential or commercial power source, or an on-board battery. FIG. 2 illustrates a top view of the exemplary embodiment of FIG. 1.

The platform 11 preferably is a wedge-shaped surface, having a first end capable of contacting a tree 30, and a second end opposite the first end. The shapes of the first end may be linear, curvilinear, or any shape. It is preferred that the width of the first end is smaller than a width of the second end. The thickness of the platform 11 may enable the control means and the power supply of the illuminating devices 21 to be housed therein. Extending downward from the first end, having a width equal to or less than the first end, is a mount 12. The mount 12 has a front wall abutting the tree 30 when placed thereon, and a pair of sidewalls that each has a strap aperture 31 that are coaligned. Alternately, the mount 12 can have a rear wall, such that the pair of apertures 31 leads to a channel that goes through the mount 12. The mount 12 is sized and shaped to enable rigid support for the platform 11 and dome 20 to be supported on the tree with the strap 30. The strap 30 can affix more than one (1) device 10 to the tree 30 (please refer to FIG. 2).

The dome 20 is supported on the platform 11, preferably in a center on an upper surface thereof. The dome 20 can either be removably attached to the platform 11, or affixed thereto, such that minimal distance exists between the illuminating devices 21 and the power supply and control means (not shown) that exists within the platform 11. The dome 20 is a semicircular body, that may have a bottom wall or not, and includes first portion that is transparent, and second portion that has a reflector 22 covering the rear thereof. The illuminating devices 21, which can be light-emitting diodes (LED's), lasers, incandescent or fluorescent bulbs, or any similar device, can be attached to a bottom wall of the dome 20, if such a bottom wall exists. The illumination 23*a* created by the illuminating devices 20 is placed in the dome 20, or on the platform 11 within the dome 20, in such a way as to be directed onto the tree 30 upon which the device 10 is mounted. Any illumination 23*a* that is directed towards the reflector 22 is then reflected as reflected illumination 23*b* and is also directed towards the tree 30.

It is envisioned that a plurality of devices 10 can be mounted to the same tree 30 in a radial pattern, and if mounted in vertical coaligned nature, then a single strap 31 can secure all devices 10 to the tree 30. The devices 10 can be mounted to branches of the tree or other structures and is not limited to cylindrical structures or even outdoor structures. The illuminating devices 21 can be all the same color and style in a single device 10, or each illuminating device 21 can be different. If the illuminating devices 21 are lasers, then the lasers can be programmable to display what is desired by the user.

The foregoing descriptions of specific embodiments of the present invention have been presented for purposes of illustration and description. They are not intended to be exhaustive or to limit the invention to the precise forms disclosed, and obviously many modifications and variations are possible considering the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A tree illumination device, comprising:

a plurality of platforms having a first side and a second side opposite said first side, said first side having a width and said second side having a width;

a dome supported on each said platform, said dome having at least one illuminating device attached therein, said dome includes a first transparent portion and a second portion having a reflector covering a rear portion thereof and extending inwards within said dome and terminating prior to said at least one illuminating device;

a control means mounted within each said platform and is in electrical communication with said at least one illuminating device;

a mount extending downward said second side, said mount having a front wall abutting a tree and a pair of sidewalls each having a coaligned strap aperture;

one or more straps each having a pair of distal ends that mate with each other, said one or more straps extending through said coaligned strap aperture and securing said tree illumination device to said tree;

a first cord extending away from each said platform, said first cord terminates in a first electrical connector; and a second cord extending away from each said platform, said second cord terminates in a second electrical connector, said first electrical connector and said second electrical connector are capable of being in electrical communication with a power source and capable of being in electrical communication with each other.

2. The tree illumination device according to claim 1, wherein said platforms are a planar wedged shaped surface.

3. The tree illumination device according to claim 1, wherein said first side is linear.

4. The tree illumination device according to claim 1, wherein said first side is curvilinear to enable greater contact with said tree.

5. The tree illumination device according to claim 1, wherein said second side is curvilinear to enable greater contact with said tree.

6. The tree illumination device according to claim 1, wherein said second side width is smaller than said first side width.

7. The tree illumination device according to claim 1, wherein said dome is centered on each said platform.

8. The tree illumination device according to claim 1, wherein said dome is removably attached to each said platform.

9. The tree illumination device according to claim 1, wherein said dome has a hemispherical body.

10. The tree illumination device according to claim 1, wherein each said at least one illuminating device is in electrical communication with a power source.

11. The tree illumination device according to claim 1, wherein said at least one illuminating device is selected from the group consisting of at least one light-emitting diode, at least one laser, at least one incandescent bulb, or at least one fluorescent bulb.

12. The tree illumination device according to claim 1, wherein said at least one illumination device is programmed to provide a pattern effect.

13. The tree illumination device according to claim 12, wherein said at least one illumination device is programmed to provide a random pattern effect.

14. The tree illumination device according to claim 1, further comprising a waterproof seal between said dome and said platforms for sealing out moisture and debris.

15. The tree illumination device according to claim 1, wherein said control means is in electrical communication with said power source.

16. The tree illumination device according to claim 1, wherein said first cord is opposite said second cord.

17. The tree illumination device according to claim 1, wherein said first cord and said second cord are in electrical communication with an over-current protection device, a power supply, and a driver circuit.

18. The tree illumination device according to claim 1, further comprising a switch located on an external surface of said platform to provide electrical power to said tree illumination device.

19. The tree illumination device according to claim 1, wherein said tree illumination device is made of plastic material.

20. The tree illumination according to claim 1, wherein said tree illumination device is made of weatherproof material.

* * * * *